US006375161B2

(12) United States Patent
Garceau

(10) Patent No.: US 6,375,161 B2
(45) Date of Patent: Apr. 23, 2002

(54) SCISSOR JACK

(75) Inventor: Bernie Garceau, Elkhart, IN (US)

(73) Assignee: Norco Industries, Inc., Elkhart, IN (US)

( * ) Notice: Subject to any disclaimer, the term of this patent is extended or adjusted under 35 U.S.C. 154(b) by 0 days.

(21) Appl. No.: 09/843,975

(22) Filed: Apr. 26, 2001

Related U.S. Application Data

(63) Continuation of application No. 09/200,375, filed on Nov. 24, 1998.

(51) Int. Cl.[7] ..... B66F 3/00
(52) U.S. Cl. ..... 254/126; 254/122; 254/124
(58) Field of Search ..... 254/122, 124, 254/126, DIG. 1, DIG. 4

(56) References Cited

U.S. PATENT DOCUMENTS 4,055,329 A 10/1977 Hammond
4,583,713 A 4/1986 Fukura et al.
4,695,036 A 9/1987 Yukimoto et al.
4,720,082 A 1/1988 Yang
4,802,653 A 2/1989 Engel
4,836,502 A 6/1989 Yamauchi
5,275,378 A 1/1994 Alten
5,303,898 A 4/1994 Engel et al.
5,449,149 A 9/1995 Popowich
5,692,730 A 12/1997 Gill

*Primary Examiner*—Joseph J. Hail, III
*Assistant Examiner*—Daniel Shanley
(74) *Attorney, Agent, or Firm*—Hahn, Loeser & Parks LLP

(57) ABSTRACT

A scissor jack assembly with double-lead Acme threaded screw. Through use of urethane or similar material as a braking means, the jack assembly is operable with a self locking action over a wider range of loads and especially at lower loads where an Acme loading phenomenon that results in said self locking action has previously been unattainable. Faster and smoother jack operation is made possible by employing a thrust bearing, including a plurality of roller or ball bearings, with the jack assembly. A spacing washer is also provided to retain the threaded shaft within the trunnions of the jack assembly, in order that the ends of each of the trunnions need not be machined or stamped to retain the trunnions within the jack assembly. Utilizing such a spacing washer decreases the costs involved with manufacturing the jack assembly, while increasing the ability to repair the jack assembly.

16 Claims, 2 Drawing Sheets

SCISSOR JACK

REFERENCE TO RELATED APPLICATIONS

This is a continuation of copending application Ser. No. 09/200,375, which was filed on Nov. 24, 1998.

FIELD OF THE INVENTION

The present invention relates generally to mechanical jacks used for raising heavy objects and, more specifically, to a screw-operated scissor jack having an expanded range of load lifting capabilities provided by use of urethane or similar material as a braking means and having faster, smoother operation made possible by use of thrust bearing that includes a plurality of ball or roller bearings.

BACKGROUND OF THE INVENTION

Screw-operated scissor jacks have long been known to be useful in lifting applications and especially in situations where it may be desired to level heavy objects. A particular type of well known screw-operated scissor jack employs a double lead Acme screw which traditionally has proven to be particularly advantageous where extremely massive objects need to be raised quickly. One industry in which jacks having the double lead Acme screw have been widely used is the railroad industry, where the need often has arisen to lift locomotives and rail cars from train tracks. For this and similar types of lifting jobs, the double lead Acme screw has been shown to be capable of raising loads up to three times faster than a standard SAE screw that has been used in other jacks.

In addition to providing a faster operating jack, the Acme double lead screw exhibits a further operational advantage that derives from the physical characteristics which are unique to the Acme screw thread. Such operational advantage is the ability for the Acme screw to become self-locking when the jack is subjected to loads generally in excess of one thousand pounds. Where loading is above the stated level, it has been determined that frictional forces developed among the thread lands or roots become sufficiently large to prevent the vertically downward directed force of the lifted object from causing the screw to unwind and prematurely allow the lifted object to descend. As already suggested, the described advantage, which also may be termed an "Acme loading phenomenon," requires that a minimum load be lifted by the jack before the Acme loading phenomenon takes effect and becomes of any benefit to the jack operator. Thus, the advantage to be gained from discovery of a means to lower the minimum load at which the jack will become self-locking has been recognized, and the present invention provides a simple and inexpensive jack construction that is aimed at achieving that end.

SUMMARY OF THE INVENTION

In accordance with a preferred embodiment of the present invention, there is provided a screw-operated scissor jack assembly including a double lead Acme screw, used for lifting and on some occasions, leveling a heavy object; the jack assembly being capable not only of raising the object at a faster rate than conventional SAE screws used for the same purposes, but also of becoming advantageously engaged in a self-locking state at loads that are markedly lower than those heretofore required to cause traditionally available scissor jack assemblies to achieve self-locking operation. The jack assembly of the present invention is comprised of: a base member having a plurality of foot-like projections provided for resting the jack assembly against a relatively hard, flat, stationary surface; a first movable arm member rotatably connected at a first end of said first movable arm member to said base member by a first bolt or similar fastening means; a second movable arm member rotatably connected at a first end of said second movable arm member to a second end of said first movable arm member by a first trunnion; a third movable arm member rotatably connected at a first end of said third arm member to said base member by a second bolt or similar fastening means; a fourth movable arm member rotatably connected at a first end of said fourth movable member to a second end of said third movable member by a second trunnion; a first and a second load supporting bracket, each of which brackets is rotatably connected to a second end of each of said second and fourth movable arm members by a third and a fourth bolt or similar fastening means; a rotatable shaft member extending within said first, second, third and fourth movable arm members and having a double lead Acme threaded screw engaged with a threaded bore provided in said second trunnion; and a turning means affixed to an unthreaded end of said rotatable shaft member and located proximate to said first trunnion, said turning means including an operating handle receiver, a thrust bearing, a ring-like braking means comprised of urethane or a similar substance; a first and second washer and a locking pin.

It is therefore an object of the present invention to provide an improved screw-operated scissor jack assembly with a double lead Acme screw, which assembly is operable at high speed and with smooth action.

It is yet another object of the present invention to provide an improved screw-operated scissor jack assembly with a double lead Acme screw, which assembly is operable with a self locking action over a wider range of loads and especially at lower loads in a range of 700–1200 pounds where an Acme loading phenomenon that results in said self locking action has previously been unattainable.

DETAILED DESCRIPTION OF THE PREFERRED EMBODIMENT

Figure 1:
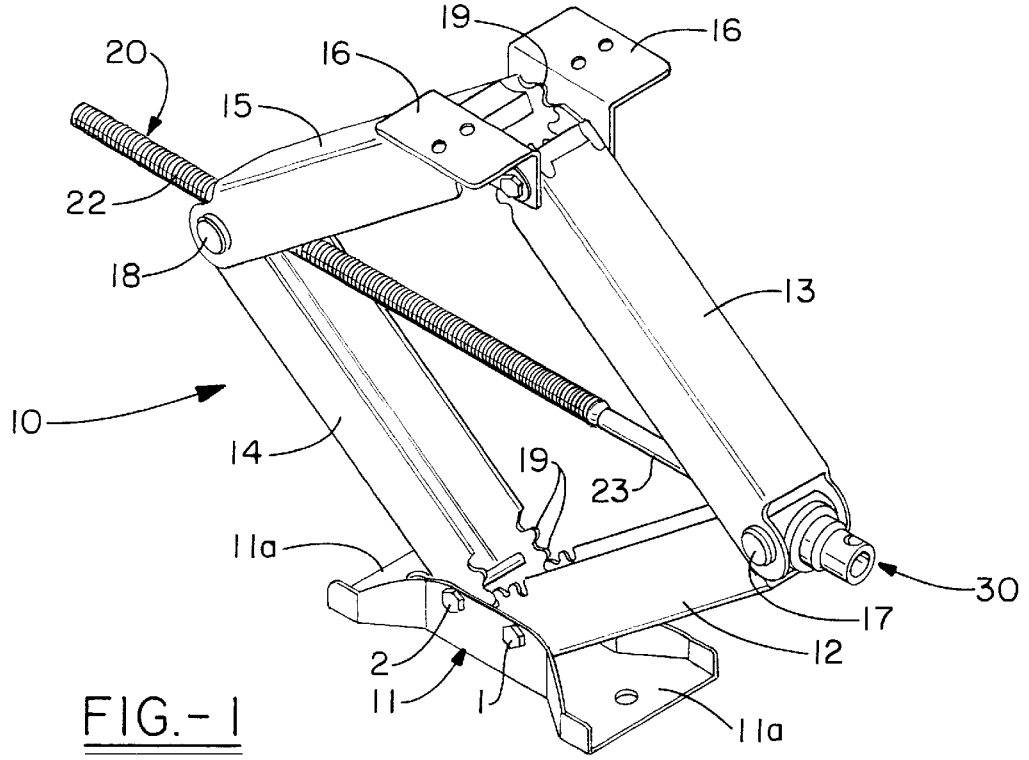
FIG. 1 is a perspective view of a jack assembly of the present invention in a raised condition.
Figure 2:
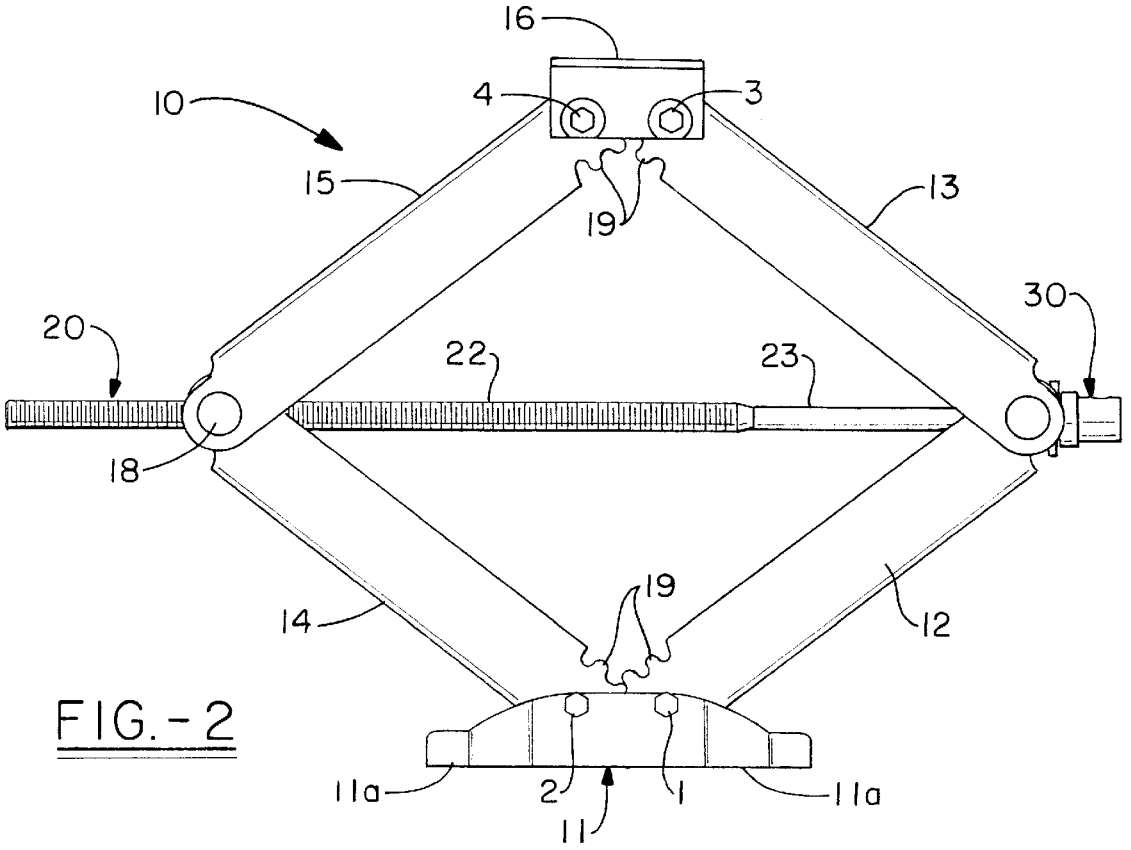
FIG. 2 is a side view of a jack assembly of the present invention in a raised condition.

A screw-operated jack assembly in accordance with a preferred embodiment of the present invention is indicated generally in FIG. 1 by the reference numeral 10. The jack assembly 10 is comprised of a base member 11 employed for resting the jack assembly 10 against a flat, stationary surface such as a concrete floor or some other relatively firm material; a first movable arm member 12 rotatably connected at a first of its two ends to the base member 11 by a first bolt 1; a second movable arm member 13 rotatably connected by a first pin or trunnion 17 at a first of its two ends to the second end of the first movable arm member 12; a third movable arm member 14 rotatably connected at a first of its two ends to the base member 11 by a second bolt 2; a fourth movable arm member 15 rotatably connected by a second pin or trunnion 18 at a first of its two ends to the second end of the third movable arm member 14; a pair of load supporting brackets 16, each of the brackets 16 making up the pair being connected by bolts 3 and 4 (the bolt 4 shown in FIG. 2) to the second ends of the second and the fourth movable arm members 13 and 15 in a manner so that the second and fourth arm members 13 and 15 are rotatable in relation to each of the load supporting brackets 16. The jack assembly 10 is further comprised of a horizontally extending, rotatable shaft member indicated generally by the numeral 20 in FIGS. 1 and 2. The rotatable shaft member 20 is provided on its outer circumference with a double lead Acme thread 22 that continuously extends from one end of the shaft member 20 and across approximately two-thirds to three-fourths of the length of the shaft member 20; and a turning means generally indicated in the drawings by the reference numeral 30 and situated on the end of the unthreaded portion 23 of the rotatable shaft member 20. Each of the trunnions 17 and 18 are provided with a bore (bore in the trunnion 17 indicated in FIG. 3 the reference numeral 17*a* and bore in the trunnion 18 not shown in the drawings) that extends perpendicularly through the center portion of the turnings 17 and 18. In the case of the trunnion 17, the bore 17*a* provided therethrough is unthreaded and is slightly larger than the diameter of the threaded portion 22 of the shaft member 20. In the case of the trunnion 18, the provided bore is threaded with a double lead Acme thread that is dimensionally compatible with the threading provided on the threaded portion 22 of the shaft member 20. As indicated in the drawings, when the jack 10 is in an assembled state, the threaded portion 22 of shaft member 20 is rotatably received by the threaded bore in trunnion 18 and the unthreaded portion 23 of the shaft member 20 is rotatably received by the bore in trunnion 17. At the ends of each of the movable arm members 12, 13, 14 and 15, that receive one of the bolts 1, 2, 3 and 4, there is provided a plurality of tab-like teeth 19. As shown in FIG. 2, the teeth on opposing ends of the arm members 12, 13, 14 and 15 mesh and permit the load supporting brackets 16 to be raised or lowered as the shaft member 20 is rotated in one direction or the other. The base member 11 is supplied with foot-like projections 11*a*. The projections 11*a* provide a means for resting the jack assembly 10 in a stable manner against a stationary surface during operation.

Figure 3:
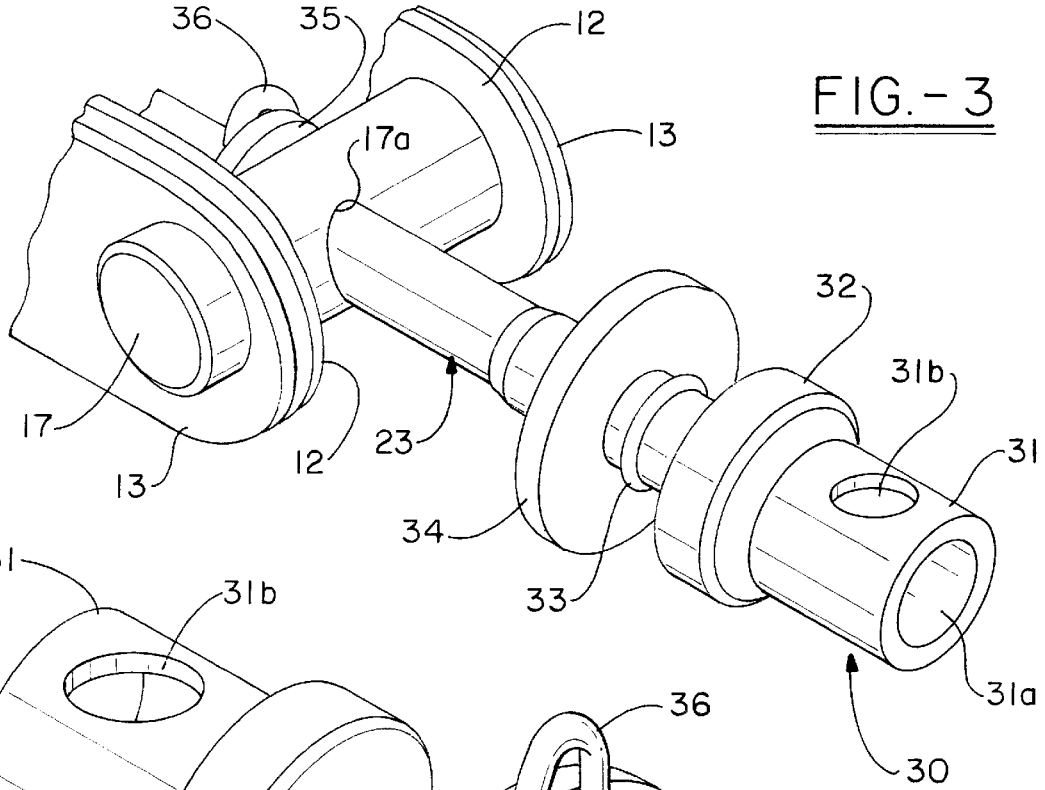
FIG. 3 is a enlarged perspective view of the turning means of the jack assembly of the present invention wherein portions of the turning means are shown in a spatially separated state.

Turning to FIG. 3, an enlarged perspective view is provided of a portion of the jack assembly 10 where movable arms 12 and 13 are joined by the trunnion 17, and the unthreaded portion 23 of the shaft member 20 passes through the unthreaded bore 17*a*. Also shown in FIG. 3, in a spatially separated (laterally) state, are the elements that comprise the turning means 30. Collectively, the turning means 30 includes: an operating handle receiver 31; a thrust bearing 32; a ring-like breaking means 33; a first washer 34; a second washer 35 and a locking pin 36.

The operating handle receiver 31 is cylindrically shaped and is provided as an enlarged diameter extension at the end of the unthreaded portion 23 of the shaft member 20. A longitudinally extending central bore 31*a* is provided in the handle receiver 31 along with a radially extending side bore 31*b* that passes through the wall of the handle receiver 31 at one location on its periphery. The central bore 31*a* receives an end of a known shaft-like, rotation causing tool (not shown) equipped with a radially projecting, spherical locking means (not shown) that engages the side bore 31*b* to prevent relative rotation between the handle receiver 31 and the rotation causing tool.

The thrust bearing 32 is located on the unthreaded portion 23 of the shaft member 20, immediately next to the operating handle receiver 31. The bearing 32 is annularly shaped, and its central opening, the diameter of which is smaller than the outside diameter of the handle receiver 31, but is larger than the diameter of the portion 23 where it is joined to the receiver 31, is provided with a plurality of bearings (ball or roller) that project toward and make contact with the outer surface of the unthreaded portion 23 lying inside of the central opening of the bearing 32.

Positioned immediately adjacent to the thrust bearing 32 is the braking means 33, which in the preferred embodiment of the invention, is in the form of an O-ring that fits snugly about the circumference of the unthreaded portion 23 of the shaft 20. Preferably, the braking means 33 is fabricated from urethane, employing known production techniques; however, any other substance having properties similar to urethane may be used as a braking means, and all such substances are intended to be within the scope of the present invention.

The first washer 34 is situated immediately beside the braking means 33 and to the outside of the trunnion 17. The first washer 34 is made of a sturdy metal such as steel and has an outer diameter that significantly exceeds the outer diameters of the receiver 31, the bearing 32 and the braking means 33, but that will allow the washer 34 to fit in the space provided at the end of the movable member 12 where it is joined by the trunnion 17 to the movable member 13. Such sizing of the washer 34 also permits it to make firm tangential contact with the trunnion 17 when the jack 10 is in its fully assembled state.

First washer 34 also acts as a spacer to properly maintain shaft member 20 and trunnion 17 between movable arms 12 and 13. Upon assembly of the jack 10, the combination of the shaft member 20, the locking pin 36 and first washer 34 holds jack 10 in its assembled position. In prior art scissor jacks, processing steps were required to hold a trunnion within the arms of the jack, while having the shaft member positioned within the trunnion. Such prior art processes include machining the lateral ends of the trunnion to provide slots for accepting snap rings on each end of the trunnion, or stamping each end of the trunnion to create an upset region or ridge, about the circumference of each end of the trunnion. Spacers, such as first washer 34, eliminate the need to machine or stamp the ends of each trunnion thereby decreasing the costs associated with manufacturing the scissor jack 10. Furthermore, using first washer 34 as a spacer to hold shaft member 20 and trunnion 17 between movable arm 12 and 13, allows for easier repair of jack 10, in contrast to stamping the ends of trunnions 17 and 18, which increases the time, effort and expense of repairing jack 10.

The second washer 35 is also made of metallic material like steel and is provided on the unthreaded portion 23 at a position that lies immediately to the inside of the trunnion 17. Like the first washer 34, the second washer 35 also makes tangential contact with the trunnion 17 when the jack 10 is fully assembled.

Figure 4:
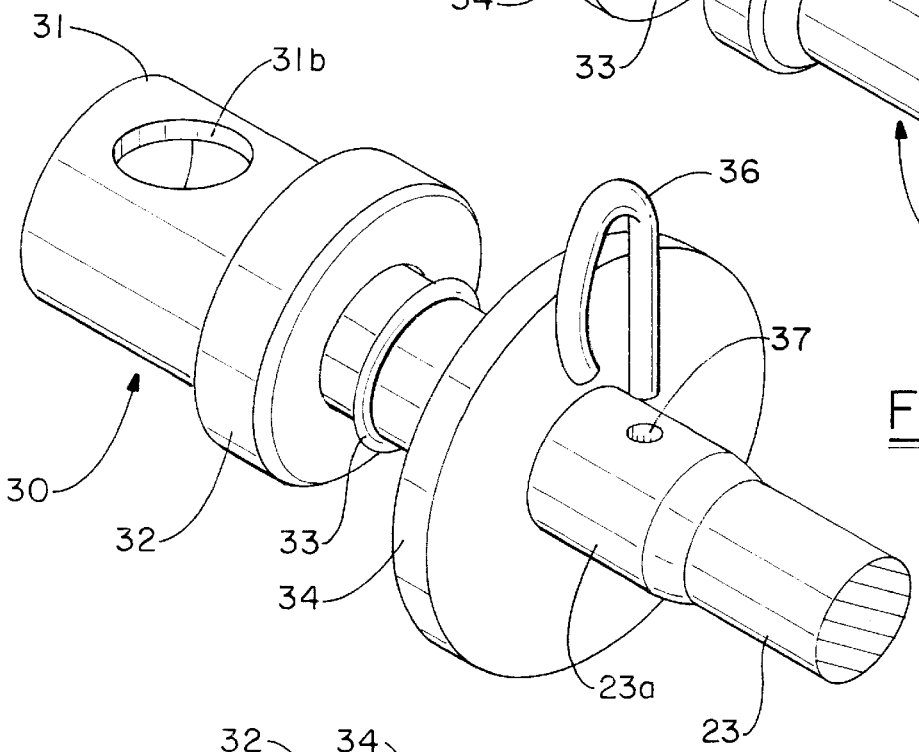
FIG. 4 is a yet another enlarged perspective view of the turning means of the present invention wherein selected portions of the turning means are shown in a spatially separated condition.

A hook-like locking pin 36 completes the turning means 30. The locking pin 36 is clearly shown in FIG. 4, where there is provided yet another spatially separated perspective view of the of components of the turning means 30. (It should be noted that the second washer 35 has been omitted from FIG. 4 for clarity purposes only.) The locking pin 36 is received by a radial bore 37 that passes through a region 23*a* of the unthreaded portion 23. The region 23*a* extends toward the operating handle receiver 31 and has a diameter that is somewhat enlarged over that of the unthreaded portion 23. As shown in FIG. 3, the pin 36 abuts the second washer 35 and thus cooperates with the operating handle receiver 31 to maintain physical contact among the components of the turning means 30 and to prevent axial translation of the unthreaded portion 23 relative to the trunnion 17.

Figure 5:
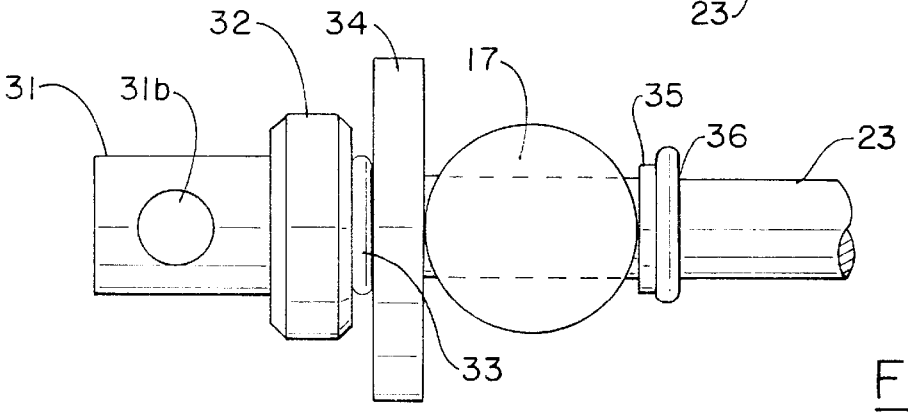
FIG. 5 is a side view of the turning means of the present invention, depicted in a non-spatially separated state.

In FIG. 5, the operating handle receiver 31, the thrust bearing 32, the braking means 33, the washer 34, the washer 35 and the locking pin 36 are shown in a non-spatially separated state, i.e., as said components would actually appear relative to the trunnion 17 and the unthreaded portion 23 of the shaft 20 when the jack 10 is in an assembled state.

In operation, the jack 10 will cause a load in contact with the load supporting brackets 16 to be raised when a rotation causing tool is engaged in the central bore 31*a* of the operating handle receiver 31 and the shaft member 20 with threaded portion 22 is caused to rotate within the threaded bore of the trunnion 18 in a direction that will cause the trunnion 18 to be drawn along the threaded portion 22 toward the trunnion 17. During a typical load-raising process, the jack 10 will first be positioned beneath the load to be lifted such that at least a small clearance space will exist between the load supporting brackets 16 and object to be raised. Next, the shaft member 20 will be turned so that the load supporting brackets 16 make contact with the object and the clearance space is eliminated. As contact is made, load from the object will be increasingly shifted to the load supporting brackets 16 and cause forces to be developed in and transmitted through the second and fourth movable arm members 13 and 15 and the trunnions 17 and 18. The force transmitted through the trunnion 18 will be transferred at the threaded bore to the double lead Acme threads 22 there within. Similarly, the force transmitted through the trunnion 17 will be directed against the washer 34 and then transferred to ring-like braking means 33, thrust bearing 32 and operating handle receiver 31. The force transmitted through the trunnion 18 to the Acme threads 22 assumes the form of a frictional force that acts between the opposing Acme thread faces and that increases in magnitude as the load of the object being lifted increases. In general, traditional screw-operated scissor jacks having double lead Acme threads need to be subjected to a load in excess of approximately 3,000 pounds before the frictional force among the threads becomes large enough to cause the conventional jack to become self-locking and thus prevent the it from lowering of its own accord if the turning force provided by the rotation causing tool against the operating handle receiver 31 is relieved. In accordance with the present invention, the magnitude of the load required to cause the jack assembly 10 to become self-locking is markedly reduced by the braking means 33 and the action of the force transferred to it through the washer 34. Recalling that in the preferred embodiment of the invention the braking means 33 is comprised of a urethane material, the force transmitted to the braking means 33 by the washer 34 causes the braking means 33 to become deformable compressed between the washer 34 and the transfer bearing 32 and to expand radially outward and inward toward the unthreaded portion 23 of the shaft 20. The expansion increases the surface areas of contact among the braking means 33 and the washer 34 and the transfer bearing 32 and at the same time causes the braking means to constrict against the unthreaded portion 23 of the shaft 20. These combined actions cause frictional forces to develop that resist lowering of the jack 10 and that combine with the frictional forces developed at the trunnion 18 among the Acme threads. The combination of the frictional forces created by the braking means 33 and the interaction of the Acme threads 22 thus causes the jack 10 to become self-locking at loading which is less than conventional jacks. By way of example, loads in the range of 700 to 1200 pounds have been found to cause the jack 10 of the present invention to engage in a self-locking condition.

Another aspect of the present invention is the transfer bearing 32. Conventional screw-operated scissor jacks generally have been long known for their slow, laborious manner of operation and for their non-fluid or erratic lifting action. The transfer bearing 32 with its plurality of ball or roller bearings that project toward and contact the outer surface of the unthreaded portion 23 of the shaft 20 has been found to eliminate these drawbacks by reducing the frictional forces that would otherwise act tangentially to the unthreaded portion 23.

While the preferred embodiment of the invention has been described above, it will be recognized and understood that various modifications may be made therein and the appended claims are intended to cover all such modifications which may fall within the spirit and scope of the invention.

What is claimed is:

1. A scissor jack assembly comprising:

a base member for resting the jack assembly against a substantially flat surface;

a support bracket assembly;

first and second lower arm members each of an open channel construction with outer side walls and having one end connected to said base plate;

first and second upper arm members each of an open channel construction with outer side walls and having one end connected to said support bracket assembly;

first and second trunnions connecting said upper arms with said lower arms;

a rotatable shaft member extending through bores in said first and second trunnions;

and at least one spacer dimensioned to substantially occupy the space between the rotatableshaft and at least one arm member sidewall for maintaining the position of said rotatable shaft within the area between planes created by the side walls of said upper or lower arm members.

2. A scissor jack assembly as recited in claim 1 wherein said at least one spacer is positioned adjacent to one of said trunnions.

3. A scissor jack assembly as recited in claim 1 wherein said at least one spacer is positioned on said rotatable shaft.

4. A scissor jack assembly as recited in claim 1 wherein said at least one spacer has a diameter slightly less than the distance between said side walls of said arm members.

5. A scissor jack assembly as recited in claim 1 wherein said at least one spacer is made of metal.

6. A scissor jack assembly as recited in claim 1 wherein said at least one spacer prevents substantial lateral movement of said shaft relative to said arm members.

7. A scissor jack assembly as recited in claim 1 wherein said at least one spacer further maintains the position of at least one trunnion.

8. A scissor jack assembly comprising:

a base member for resting the jack assembly against a substantially flat surface;

a support bracket assembly;

first and second lower arm members each of an open channel construction with outer side walls and having one end connected to said base plate;

first and second upper arm members each of an open channel construction with other side walls and having one end connected to said support bracket assembly; bracket assembly;

first and second trunnions connecting said upper arms with said lower arms;

a rotatable shaft member extending through bores in said first and second trunnions; and at least one spacer dimensioned to substantially occupy the space between the side walls of an upper or lower arm member for maintaining the position of said rotatable shaft within the area between planes created by the side walls of said upper or lower arm members.

9. A scissor jack assembly as recited in claim 8 wherein said at least one spacer is positioned adjacent to one of said trunnions.

10. A scissor jack assembly as recited in claim 8 wherein said upper and lower arm members are of an open channel construction having outer side walls.

11. A scissor jack assembly as recited in claim 8 wherein said at least one spacer is positioned on said rotatable shaft.

12. A scissor jack assembly as recited in claim 8 wherein said at least one spacer is made of metal.

13. A scissor jack assembly as recited in claim 8 wherein said at least one spacer prevents substantial lateral movement of said shaft relative to said arm members.

14. A scissor jack assembly as recited in claim 8 wherein said at least one spacer substantially occupies the space between said rotatable shaft and and at least one arm member outer side wall.

15. A scissor jack assembly as recited in claim 8 wherein said at least one spacer further maintains the position of at least one trunnion.

16. A scissor jack assembly as recited in 8 wherein said at least one spacer has a diameter slightly less than the distance between said side walls of said arm members.

* * * * *